US006893270B2

(12) United States Patent
Sercu

(10) Patent No.: US 6,893,270 B2
(45) Date of Patent: May 17, 2005

(54) PADDLE-CARD TERMINATION FOR SHIELDED CABLE

(75) Inventor: Stefaan Sercu, Brasschaat (BE)

(73) Assignee: FCI Americas Technology, Inc., Reno, NV (US)

( * ) Notice: Subject to any disclaimer, the term of this patent is extended or adjusted under 35 U.S.C. 154(b) by 31 days.

(21) Appl. No.: 10/444,306

(22) Filed: May 23, 2003

(65) Prior Publication Data

US 2004/0023557 A1 Feb. 5, 2004

Related U.S. Application Data

(60) Provisional application No. 60/383,403, filed on May 24, 2002.

(51) Int. Cl.[7] ..... H01R 12/00

(52) U.S. Cl. ..... 439/76.1; 439/610

(58) Field of Search ..... 439/76.1, 610, 439/497, 579, 941, 60, 924.1, 930; 174/88 R, 75 C, 78

(56) References Cited

U.S. PATENT DOCUMENTS 5,114,364 A * 5/1992 Hunter ..... 439/497
5,679,008 A 10/1997 Takahashi et al.
6,203,333 B1 * 3/2001 Medina et al. ..... 439/76.1
6,210,229 B1 4/2001 Lai
6,217,372 B1 4/2001 Reed
6,328,588 B1 12/2001 Tsai et al.
6,336,827 B1 1/2002 Akama et al.
6,380,485 B1 * 4/2002 Beaman et al. ..... 174/88 R
6,468,110 B2 10/2002 Fujino et al.
6,524,135 B1 2/2003 Feldman et al.
6,575,772 B1 * 6/2003 Soubh et al. ..... 439/76.1
6,685,501 B1 * 2/2004 Wu et al. ..... 439/497
6,685,511 B2 * 2/2004 Akama et al. ..... 439/610

* cited by examiner

*Primary Examiner*—Tho D. Ta
*Assistant Examiner*—Edwin A. Leon
(74) *Attorney, Agent, or Firm*—Woodcock Washburn LLP

(57) ABSTRACT

A preferred embodiment of a cable harness assembly includes a shielded cable comprising a first and a second conductor for conducting a pair of differential signals, and a generally planar board having a first and a second electrically-conductive trace formed thereon and having a first and a second major surface. The first trace is electrically coupled to the first conductor at a first location on the first major surface and extends along the first major surface to a second location on the first major surface. The second trace is electrically coupled to the second conductor at a third location on the first major surface and extends along the first and the second major surfaces to a fourth location on the second major surface.

22 Claims, 5 Drawing Sheets

PADDLE-CARD TERMINATION FOR SHIELDED CABLE

This application claims the benefit under 35 U.S.C. §119(e) of U.S. Provisional Patent Application No. 60/383,403, which was filed on May 24, 2002 and is hereby incorporated by reference in its entirety.

RELATED APPLICATIONS

The present application is related to co-pending U.S. patent application Ser. No. 10/391,388, filed Mar. 18, 2003, and co-pending U.S. patent application Ser. No. 10/417,521, filed Apr. 17, 2003.

FIELD OF THE INVENTION

The present invention relates to electrical connectors and, more particularly, to a paddle-card termination for a shielded electrical cable.

BACKGROUND OF THE INVENTION

The speed and capacity of computing systems are constantly on the rise. Furthermore, computing systems are being interconnected in increasingly complex networks. In order to keep pace with these developments, new interconnect systems such as, for example, the InfiniBand architecture have been proposed. The InfiniBand architecture is an industry standard, channel-based, switched fabric, interconnect architecture, with a primary application in the area of server interconnection. InfiniBand promises to provide reliable interconnect performance at speeds ranging from 2.5 to 30 Gbits/second.

The InfiniBand standard, and others like it such as, for example, 10 Gbit Ethernet, represent notable advances in interconnect speeds. At the relatively high speeds provided by these technologies, the highest levels of electrical performance are required of the physical interconnect devices. For example, creating a stable contact interface with precise impedance matching is essential. Likewise, electromagnetic interference and leakage must be minimized. Furthermore, these characteristics must be provided in a physical form that is mechanically operable in real world situations and capable of being manufactured consistently in large quantities.

Paddle-card terminations are commonly used an interface between electrical cables and electrical components. FIGS. 7A and 7B depict a conventional paddle-card termination 100. The cable termination 100 has a vertical pin out requirement, and is adapted to terminate a plurality of shielded cables 11.

Each of the cables 11 comprises a pair of conductors 20*a*, 20*b* suitable for conducting differential electrical signals. The conductors 20*a*, 20*b* are each covered by a respective layer of insulation 22*a*, 22*b*. Each cable 11 also comprises a drain line (not shown, for clarity). The cables 11 each include a shielded jacket 24 that covers the two conductors 20*a*, 20*b*, their respective insulation layers 22*a*, 22*b*, and the drain line (not shown).

The paddle-card termination 100 comprises a board 102 formed from an insulative material such as molded plastic. The board 102 has a first major surface 104 that forms a first side of the board 102, and a second major surface 106 that forms an opposing second side of the board 102.

A first of electrically-conductive pads 108*a* are disposed on the first major surface 104, proximate a first end of the board 102. A plurality of electrically-conductive pads 108*b* are disposed on the second major surface 106, proximate the first end of the board 102. The pads 108*a*, 108*b* are adapted to mate with the conductors 20*a*, 20*b* of the cables 11, as described in detail below.

A plurality of electrically-conductive pads 109*a* are disposed on the first major surface 104 of the board 102, proximate a second end of the board 102. A plurality of electrically-conductive pads 109*b* are disposed on the second major surface 106, proximate the second end of the board 102.

The pads 109*a*, 109*b* are substantially identical. Each pad 109*a* is substantially aligned with a corresponding pad 109*b*. In other words, each pad 109*a* is located directly above one of the pads 109*b*, as depicted in FIG. 7B. Each vertically-aligned pair of pads 109*a*, 109*b* is each adapted to contact a respective vertically-aligned pair of contacts on the contact on the mating component. This contact electrically couples the paddle-card termination 100 and the mating component.

As mentioned above, the mating component has a vertical pin-out requirement. In other words, the contacts on the electrical component that mate with the paddle-card termination 100 are arranged in at least two rows, with the first rows being located directly below the second. This requirement is satisfied in conventional prior art paddle-card terminations as follows, with reference to FIGS. 7A, 7B.

A plurality of conductive traces 114 are disposed on the board 102 to electrically couple the pads 108*a*, 108*b* with the pads 109*a*, 109*b*. A first plurality of the traces 114 each extend between one of the pads 108*a* and one of the pads 109*a*, as shown in FIG. 7B. A second plurality of the traces 114 (not visible in the figures) each extend between one of the pads 108*b* and one of the pads 109*b*.

Each of the cables 11 is connected to one of the pads 108*a* or one of the pads 108*b* by conventional means such as soldering. More particularly, each of the conductors 20*a* is electrically and mechanically coupled to a corresponding one of the pads 108*a*. Each of the conductors 20*b* is likewise electrically and mechanically coupled to a corresponding one of the pads 108*b*.

Moreover, the conductors 20*a*, 20*b* of each cable 11 are coupled to vertically-aligned pairs of pads 108*a*, 108*b*. Each vertically-aligned pair of pads 108*a*, 108*b*, in turn, is electrically coupled to a corresponding vertically-aligned pair of pads 109*a*, 109*b*. Hence, differential signals from the conductors 20*a*, 20*b* of each cable 11 are transmitted to a corresponding pair of vertically-oriented contacts on the mating component, thereby satisfying the vertical pin-out requirement of the mating component.

Cross talk between the conductors 20*a*, 20*b* the cables 11 can produce errors in the data being transmitted through the cables 11, and should therefore be limited. Moreover, the ongoing increases in signal speeds being achieved in the electronics industry can exacerbate the adverse effects of cross talk. Conventional cable terminations 100 of the prior art such as the cable termination 100 can be a source of such cross talk. A need therefore exists for a cable termination that minimizes cross talk transmitted through the cable termination.

SUMMARY OF THE INVENTION

A preferred embodiment of a cable harness assembly comprises a shielded cable comprising a first and a second conductor for conducting a pair of differential signals and a shield at least partially covering the first and the second conductors. The cable harness assembly further comprises a paddle-card termination comprising a generally planar board having a first and a second electrically-conductive trace formed thereon and having a first and a second major surface. The first trace is electrically coupled to the first conductor at a first location on the first major surface and extends along the first major surface to a second location on the first major surface. The second trace is electrically coupled to the second conductor at a third location on the first major surface and extends along the first and the second major surfaces to a fourth location on the second major surface.

Another preferred embodiment of a cable harness assembly comprises a paddle-card termination comprising a generally planar board having a first and a second electrically-conductive trace formed thereon and having a first and a second major surface, a first, second, and third electrically-conductive pad disposed on the first major surface, a fourth electrically-conductive pad disposed on the second surface, a first electrically-conductive trace extending between the first and the third pads, and a second electrically-conductive trace extending between the second and the fourth pads. The cable harness assembly also comprises a shielded cable comprising a first conductor electrically and mechanically coupled to the first pad and a second conductor electrically and mechanically coupled to the second pad.

A preferred embodiment of a plug assembly adapted to electrically couple a receptacle adapted to mate with the plug assembly and a shielded cable comprising a first and a second conductor comprises an insulative body having a first and a second electrically-conductive trace formed thereon and each being adapted to engage a respective contact on the receptacle. The plug assembly also comprises a paddle-card termination comprising a generally planar board having a first and a second major surface, and a first and a second electrically-conductive pad disposed on the first surface and adapted to be electrically and mechanically coupled to the respective first and second conductors.

The plug assembly further comprises a first and a second contact mounted on the body and coupled to a respective one of the first and second electrically-conductive traces. The first contact is mechanically coupled to the first major surface and electrically coupled to the first electrically-conductive pad and the second contact is mechanically coupled to the second major surface and electrically coupled to the second conductor.

A preferred embodiment of a connector system comprises a plurality of shielded cables each comprising a first and a second conductor for conducting a pair of differential signals. The connector system also comprises a plug assembly comprising an insulative body, a plurality of contacts mounted on the body in a first and a second row, and a paddle-card termination at least partially disposed between the first and the second rows. The first and the second conductors of each of the cables are mechanically coupled to a common side of the board, the first conductor of each of the cables is electrically coupled to one of the contacts in the first row, and the second conductor of each of the cables is electrically coupled to one of the contacts in the second row.

The connector system also comprises a receptacle adapted to mate with the plug assembly. The receptacle comprises a plurality of contacts each being adapted to electrically contact a respective one of the contacts of the plug assembly when the receptacle is mated to the plug assembly.

BRIEF DESCRIPTION OF THE DRAWINGS

The foregoing summary, as well as the following detailed description of a preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

Figure 1:
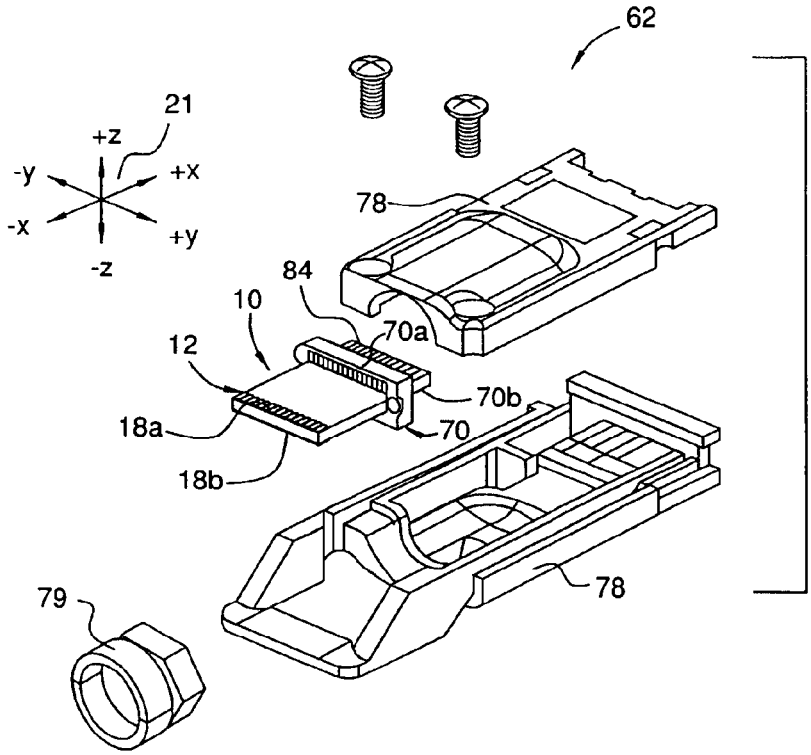
FIG. 1 is an exploded perspective view of a plug assembly that incorporates a preferred embodiment of a paddle-card cable termination according to the invention.

A connector system comprising a preferred embodiment of a paddle-card cable termination 10 is depicted in FIGS. 1 to 6A. The cable termination 10 terminates a plurality of the shielded cables 11 as generally described above with respect to the conventional paddle-card cable termination 100. The interface between the paddle-card termination 10 and the cables 11 is described in detail below.

The paddle-card termination 10 forms part of a plug assembly 62. The plug assembly 62 is adapted to mate with a receptacle 64 having a specific fixed and predetermined vertical pin-out requirement (see FIG. 2). The receptacle 64 is adapted to be mounted on and electrically coupled to a substrate 68. The plug assembly 62 and the receptacle 64 form a connector system for electrically coupling the cable 11 and the substrate 68. The connector system is described in detail for exemplary purposes only, as the preferred embodiment of the cable termination can be used in conjunction with any connector system requiring a paddle-card cable termination.

The plug assembly 62 comprises an insulative body 70, a plurality of contacts 74, a casing 78, and the paddle-card termination 10. The contacts 74 are mounted on the body 70 (see FIG. 4). Half of the contacts 74 are arranged in a first, or upper, row 80, and the remaining contacts 74 are arranged in a second, or lower, row 82.

The contacts 74 in the upper row 80 are spaced apart from the contacts 74 in the lower row 82. Each of the contacts 74 in the upper row 80 is vertically aligned with a corresponding contact 74 in the lower row 82. In other words, each contact 74 in the lower row 82 is located directly below a corresponding contact 74 in the upper row 80 when the plug assembly 62 is oriented as shown in the figures. (It should be noted that directional terms such as "upper," "lower,"

"vertical," etc. are used with reference to the component orientations depicted in the figures. These terms are used for illustrative purposes only, and are not intended to limit the scope of the appended claims.)

Figure 4:
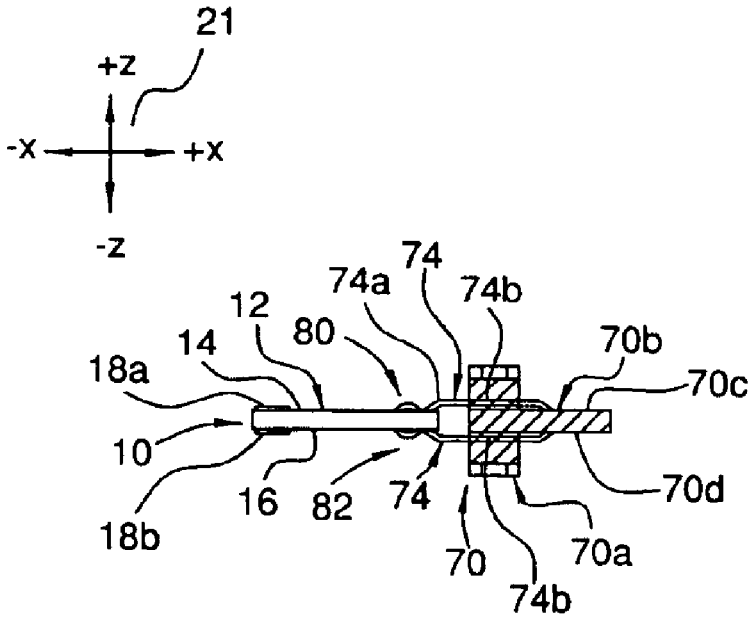
FIG. 4 is a simplified side view of the preferred embodiment of a paddle-card termination, a body, and a plurality of contacts of the plug assembly according to the invention.
Figure 5:
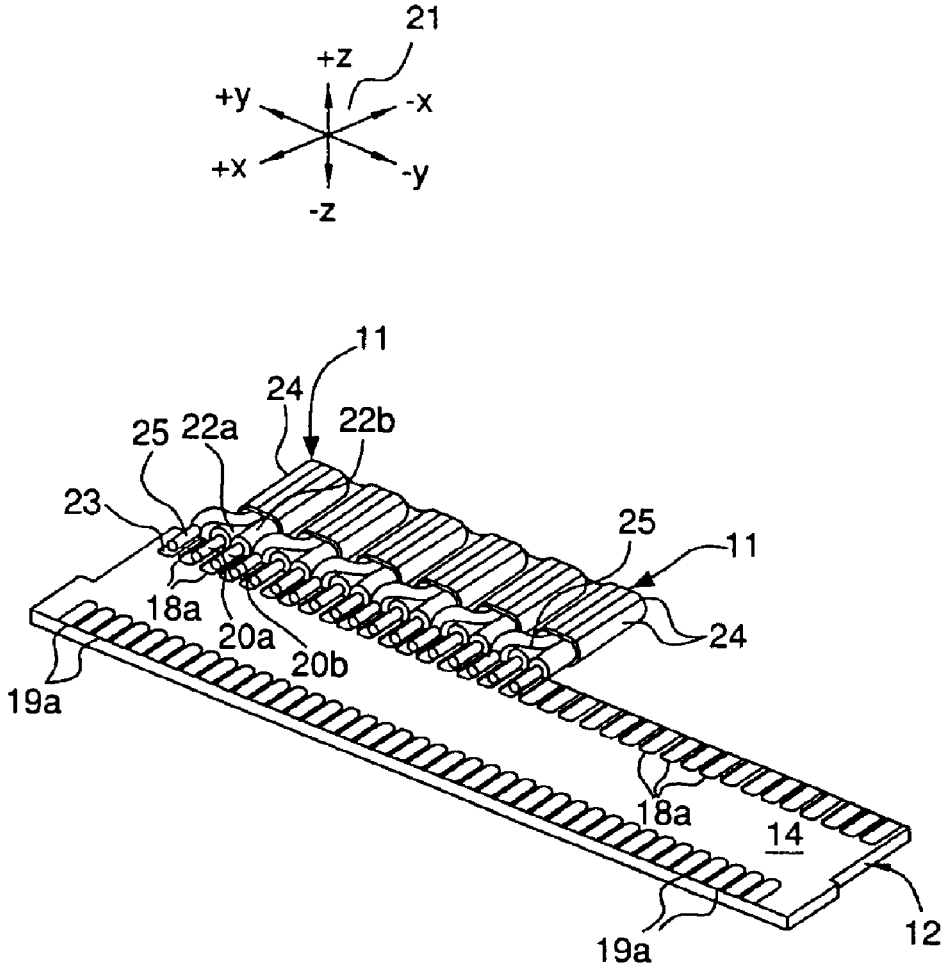
FIG. 5 is a perspective view of the preferred embodiment of a cable termination according to the invention coupled to a plurality of shielded cables.

Each of the contacts 74 has a beam portion 74*a* and an adjoining pin portion 74*b* (see FIG. 4). The pin portion 74*b* of each contact 74 is mounted in the body 70. This arrangement causes the beam portion 74*a* to extend from the body 70.

The beam portions 74*a* of the contacts 74 engage the paddle-card termination 10. More particularly, and end portion of the paddle-card termination 10 is positioned between the upper and lower rows 80, 82 of contacts 74, i.e., the upper and lower rows 80, 82 of contacts 74 straddle an end portion of the paddle-card termination 10. The beam portions 74*a* are mechanically and electrically coupled to the paddle-card termination 10. Further details concerning the interface between the contacts 74 and the paddle-card termination 10 are presented below.

The body 70 of the plug assembly 62 has a main portion 70*a* and a shelf portion 70*b* that extends from the main portion 70*a*. Electrically-conductive traces 84 are disposed on upper and lower surfaces 70*c*, 70*d* of the shelf portions 74*b* of the contacts 74 each extend through the main portion 70*a*, and contact a respective trace 84.

Figure 3:
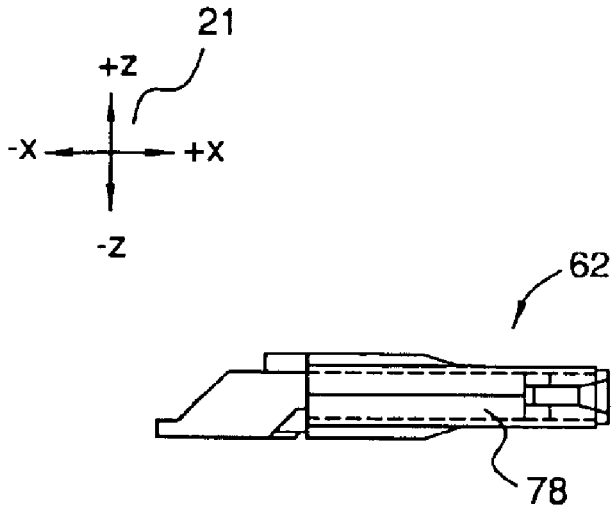
FIG. 3 is a side view of the plug assembly shown in FIG. 1.

The body 70, contacts 74, and paddle-card termination 10 are housed in the casing 78 (see FIGS. 1 and 3). The casing 78 is preferably formed from a material, such as nickel-plated zinc, that shields the plug assembly 62 from externally-generated electromagnetic interference. The plug assembly 62 also includes a cable collar 79 that secures the cables 11 to the casing 78.

Figure 2:
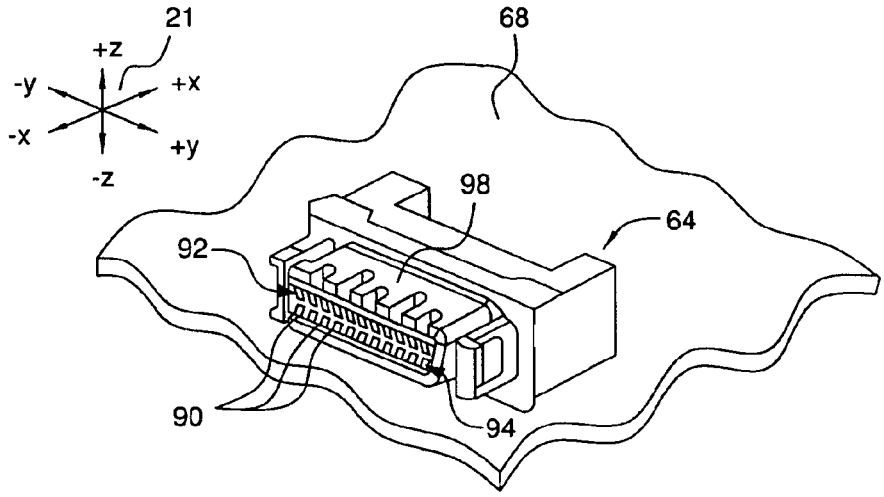
FIG. 2 is a perspective view of a receptacle adapted to mate with the plug assembly shown in FIG. 1.

The receptacle 64 comprises a plurality of contacts 90 housed in a shell 98 (see FIG. 2). Half of the contacts 90 are arranged in a first, or upper, row 92, and the remaining contacts 90 are arranged in a second, or lower, row 94. The contacts 90 in the upper row 92 are spaced apart from the contacts 90 in the lower row 94. Moreover, each of the contacts 90 in the upper row 92 is vertically aligned with a corresponding contact 90 in the lower row 94. In other words, the receptacle 64 must have a vertical pin out requirement that corresponds to that of plug assembly 62.

The contacts 90 are adapted to engage the traces 84 of the plug assembly 62. In particular, the contacts 90 in the upper row 92 and the contacts 90 in the lower row 94 straddle the shelf portion 70*b* of the body 70 when the plug assembly 62 is mated with the receptacle 64. Moreover, the contacts 90 are arranged so the each of the contacts 90 substantially aligns with and contacts a corresponding trace 84 when the plug assembly 62 and the receptacle 64 are mated, thereby establishing electrical contact between the plug assembly 62 and the receptacle 64.

Further details relating to the receptacle 64 are not necessary to an understanding of the invention, and therefore are not presented herein.

The concept of the invention was achieved when Applicant was trying to reduce the cross-talk in the receptacle while working within the constraints of the specific vertical pin out requirements that cannot be changed.

Applicant has found that coupling the conductors 20*a*, 20*b* of a particular cable 11 to the same side of the board 12 provides substantial advantages relating to crosstalk reduction. In particular, the noted coupling arrangement minimizes the amount of shielding 24 that must be removed from the cable 11 to permit the conductors 20*a*, 20*b* to be mated with the pads 18*a*, 18*b*.

Each of the cables 11, as noted previously, comprises a pair of conductors 20*a*, 20*b* suitable for conducting differential electrical signals. The two conductors 20*a*, 20*b* are each covered by a respective layer of insulation 22*a*, 22*b*. Each cable 11 also comprises a drain line 25 (see FIG. 5; the drain lines 25 are not depicted any of the other figures, for clarity). The drain lines 25 are each coupled to a ground plane 23 disposed on the first and the second major surface 14, 16 of the board 12.

The cables 11 each include a shielded jacket 24 that covers the two conductors 20*a*, 20*b*, their respective insulation layers 22*a*, 22*b*, and drain line 25 of the cable 11. (It should be noted that several of the cables 11 are not depicted in FIG. 5, again for clarity.)

Details concerning to the paddle-card termination 10 are as follows. The paddle-card termination 10 comprises a board 12 formed from an insulative material such as molded plastic. The board 12 has a first major surface 14 that forms a first side of the board 12, and a second major surface 16 that forms an opposing second side of the board 12 (see FIGS. 4–6B).

A first plurality of electrically-conductive pads 18*a* are disposed on the first major surface 14, proximate a first end of the board 12. A second plurality of electrically-conductive pads 18*b* are disposed on the second major surface 16, proximate the first end of the board 12.

The pads 18*a*, 18*b* are substantially identical. Each of the pads 18*a* is substantially aligned with a corresponding one of the pads 18*b*. In other words, each pad 18*a* is located directly above one of the pads 18*b* when the paddle-card termination 10 is oriented as depicted in the Figures.

A third plurality of electrically-conductive pads 19*a* are disposed on the first major surface 14 of the board 12, proximate a second end of the board 12. A fourth plurality of electrically-conductive pads 19*b* are disposed on the second major surface 16, proximate the second end of the board 12.

The pads 19*a*, 19*b* are substantially identical. Each pad 19*a* is substantially aligned with a corresponding pad 19*b*. In other words, each pad 19*a* is located directly above one of the pads 19*b* when the paddle-card termination 10 is oriented as depicted in the figures.

The pads 19*a*, 19*b* are each electrically and mechanically coupled to a beam portion 74*a* of a corresponding one of the contacts 74 (see FIG. 4). In other words, the pads 19*a*, 19*b* are arranged on the board 12 so that each of the pads 19*a*, 19*b* substantially aligns with and contacts a corresponding beam portion 74*a* when the paddle-card termination 10 is mated with the body 70 and the contacts 74. The beam portions 74*a* are preferably coupled to the corresponding pads 19*a*, 19*b* by soldering.

Each of pads 18*a*, 18*b* are electrically and mechanically connected to pads 19*a*, 19*b* by circuit traces, as described below.

Each of the cables 11 is connected to one of the pads 18*a* or one of the pads 18*b* by conventional means such as soldering. More particularly, the conductors 20*a*, 20*b* of a first plurality of the cables 11 are electrically and mechanically coupled to adjacent ones of the pads 18*a* on first major surface 14 of board 12. The conductors 20*a*, 20*b* of a second plurality of the cables 11 are likewise electrically and mechanically coupled to adjacent ones of the pads 18*b* on second major surface 16 of board 12. Hence, the conductors 20*a* are located on alternating ones of the pads 18*a* or the pads 18*b*, and the conductors 20*b* are likewise located on the other of alternating ones of the pads 18*b* or the pads 18*a*.

The jacket 24 is removed from an end portion of each cable 11 before the cable 11 is coupled to the pads 18*a*, 18*b*. In addition, the insulation layers 22*a*, 22*b* are stripped from the respective ends of the conductors 20*a*, 20*b* to expose the conductors 20*a*, 20*b*. These actions facilitate mating of the conductors 20*a*, 20*b* to the pads 18*a*, 18*b*.

The length of the jacket 24 and insulation layers 22*a*, 22*b* removed from each cable 11 can now be reduced from the prior art and thus minimized. More particularly, the portion of the jacket 24 and insulation layers 22*a*, 22*b* removed from each cable 11 is preferably limited to that only necessary to allow the conductors 20*a*, 20*b* of that cable 11 to reach adjacent ones of the pads 18*a* or the pads 18*b*. The significance of this feature is discussed below.

Figure 7A:
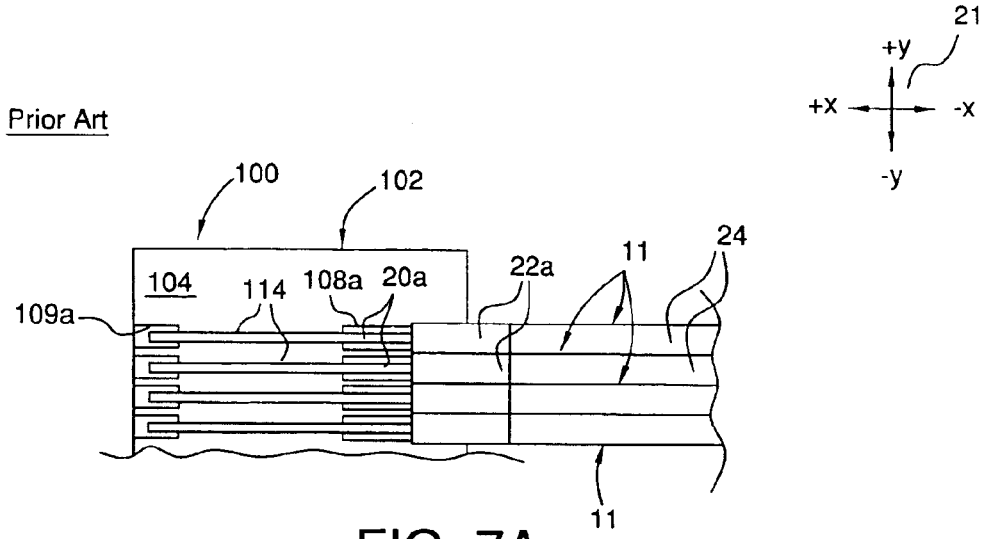
FIG. 7A is a diagrammatic top view of a conventional cable termination coupled to the shielded cables shown in FIGS. 5, 6A, and 6B.
Figure 7B:
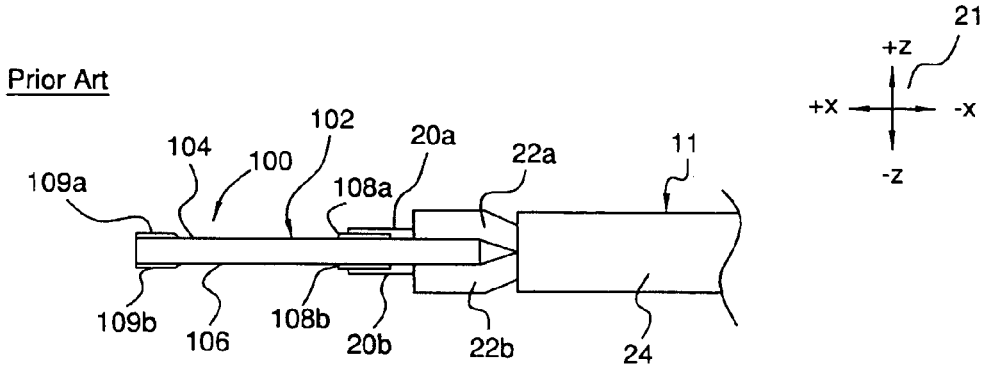
FIG. 7B is a diagrammatic side view of the cable termination coupled to the shielded cables shown in FIGS. 5, 6A, 6B, and 7A.

FIGS. 7A and 7B indicate, however, that in the prior art configuration when a vertical wiring configuration is use, each of the conductors 20*a*, 20*b* of each cable 11 must be spread apart to reach opposite sides of the board 102 when the cables 11 are mated with the conventional cable termination 100. Spreading the conductors 20*a*, 20*b* in this manner necessitates removal of the shielding 24 prior to the point at which the cable 11 meets the board 102.

Figure 6A:
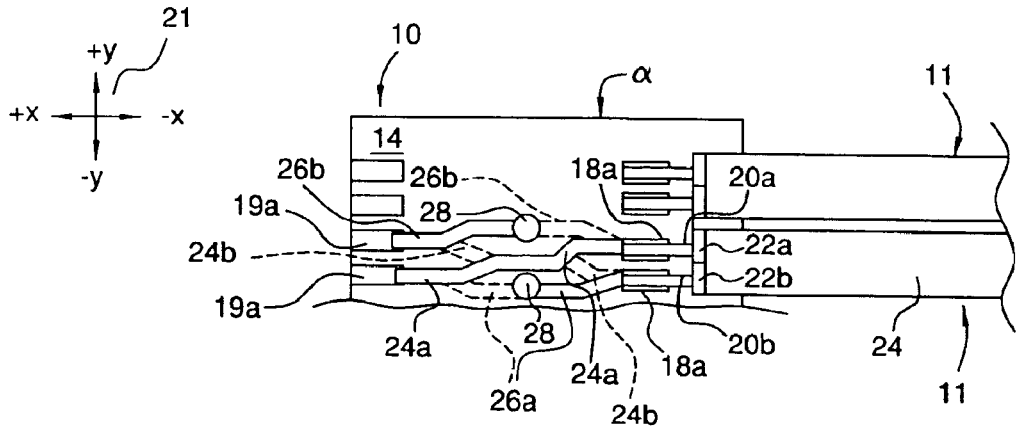
FIG. 6A is a diagrammatic top view of the exemplary cable termination according to the invention further incorporating a novel paddle board circuit trace arrangement.
Figure 6B:
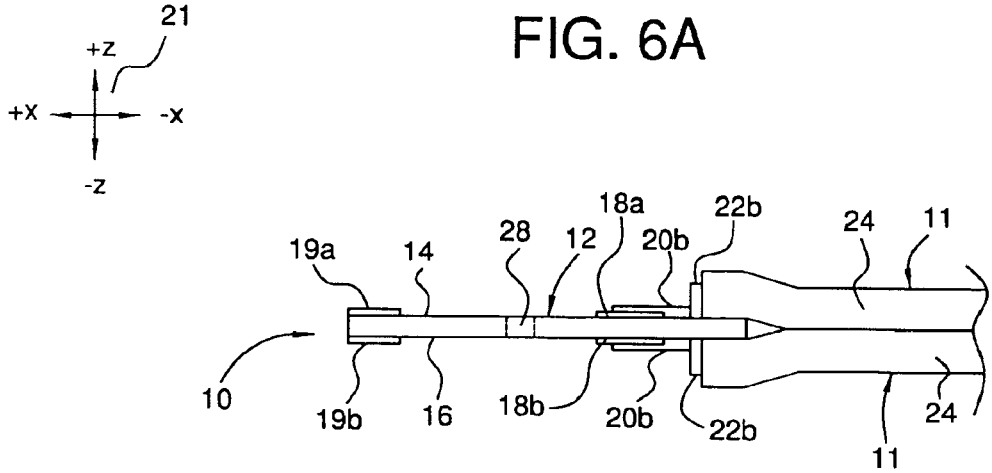
FIG. 6B is a diagrammatic side view of the structure shown in FIG. 6B.

FIGS. 6A and 6B, by contrast, indicate that the shielding 24 can remain on each cable 11 beyond the point at which the cable 11 meets the board 12 when the conductors 20*a*, 20*b* are coupled to the board 12 of the paddle-card termination 10. In other words, less shielding 24 needs to be stripped from the cable 11 when the conductors 20*a*, 20*b* are mated with a common side of the board 12.

The shielding 24 reduces or eliminates cross talk between the cables 11. Hence, increasing the amount of shielding 24 that remains on the cables 11 reduces the cross talk that occurs between the cables 11. In other words, minimizing the amount of shielding 24 that must be removed from the cables 11 to mate the cables 11 with the board 12 minimizes the cross-talk that occurs between the cables 11.

The paddle-card termination 10, by accommodating the conductors 20*a*, 20*b* from a particular cable 11 on a common side of the board 12, is believed to minimize the cross talk between the cables 11. Moreover, the paddle-card termination 10 can achieve this characteristic while satisfying the vertical pin out requirement of the receptacle 64.

To convert the row pad pattern of the first end of board 12 to the fixed predetermined specific vertical pin out pattern of the second end of board 12 a novel trace pattern was needed. An exemplary of such a trace pattern is set forth below.

A plurality of conductive traces 24*a*, 24*b*, 26*a*, 26*b* are disposed on the board 12 to electrically couple the pads 118*a*, 18*b* with the pads 19*a*, 19*b*. Details concerning the routing of the traces 24, 26 are as follows. For clarity, the conductive traces are depicted in FIG. 6A only. Moreover, only one each of the conductive traces 24*a*, 24*b*, 26*a*, 26*b* are depicted in FIG. 6A. The remaining conductive traces 24*a*, 24*b*, 26*a*, 26*b* are arranged in the same relative manner as depicted in FIG. 6A.

Each of the traces 24*a*, 24*b* is electrically coupled to a respective conductor 20*a* of the cable 11. The traces 24*a* each extend between one of the pads 18*a* and one of the pads 19*a*. The traces 24*a* are disposed entirely on the first major surface 14 of the board 12.

The traces 24*a* each extend between a pad 18*a* and a pad 19*a* that are offset with respect to the lengthwise ("x") direction of the board 12 (see FIG. 6B). (The "x" direction is denoted on a common coordinate system 21 included in each figure.) More particularly, each of the pads 18*a* is substantially aligned with a respective one of the pads 19*a* with respect to the lengthwise direction of the board 12. Each trace 24*a* extends between a pad 18*a*, and a pad 19*a* adjacent to the pad 19*a* that is aligned with that particular pad 18*a*.

The traces 24*b* each extend between one of the pads 18*b* and one of the pads 19*b*. The traces 24*b* are disposed entirely on the second major surface 16 of the board 12.

The traces 24*b* each extend between a pad 18*b* and a pad 19*b* that are offset with respect to the lengthwise direction of the board 12. More particularly, each of the pads 18*b* is substantially aligned with a respective one of the pads 19*b* with respect to the lengthwise direction of the board 12. Each trace 24*b* extends between a pad 18*b*, and a pad 19*b* adjacent to the pad 19*b* that is aligned with that particular pad 18*b*.

Each of the traces 26*a*, 26*b* is electrically coupled to a respective conductor 20*b* of the cable 11. The traces 26*a* each extend between one of the pads 18*a* and one of the pads 19*b*, as shown in FIG. 6A.

Each trace 26*a* extends between a pad 18*a* and a pad 19*b* that are substantially aligned in relation to the lengthwise direction of the board 12. The traces 26*a* are each disposed partially on the first major surface 14, and partially on the second major surface 16 of the board 12. More particularly, each trace 26*a* extends along the first major surface 14, between a corresponding one of the pads 18*a* and a plated via 28 formed in the board 12. The trace 26*a* passes from the first major surface 14 to the second major surface 16 through the via 28. The trace 26*a* subsequently extends along the second major surface 16, between a corresponding via 28 and one of the pads 19*b*.

Each trace 26*b* extends between a pad 18*b* and a pad 19*a* that are substantially aligned in relation to the lengthwise direction of the board 12. The traces 26*b* are each disposed partially on the first major surface 14, and partially on the second major surface 16 of the board 12. More particularly, each trace 26*b* extends between a corresponding pad 18*b* and one of the vias 28. The trace 26*b* passes from the second major surface 16 to the first major surface 14 through the via 28. The trace 26*b* subsequently extends along the first major surface 14, between a corresponding via 28 and one of the pads 19*a*.

The above-noted routing of the traces 24*a*, 24*b*, 26*a*, 26*b* makes the paddle-card termination 10 compatible with the receptacle 64. More particularly, the receptacle 64 is adapted to mate with vertically-aligned pairs of electrically-conductive traces 84, as noted previously. This requirement is satisfied in the paddle-card termination 10 by routing the traces 24*a*, 26*b* between the first and second major surfaces 14, 16 through the vias 28. The vertical pin-out requirement is also satisfied by routing the traces 24*a* between pads 18*a* and 19*a* that are offset with respect to the lengthwise direction of the board 12, and by routing the traces 24*b* between pads 18*b* and 19*b* that are likewise offset.

It is to be understood that even though numerous characteristics and advantages of the present invention have been set forth in the foregoing description, the disclosure is illustrative only and changes may be made in detail within the principles of the invention to the full extent indicated by the broad general meaning of the terms in which the appended claims are expressed.

What is claimed:

1. A cable harness assembly, comprising:

a shielded cable comprising a first and a second conductor for conducting a pair of differential signals and a shield at least partially covering the first and the second conductors; and a paddle-card termination comprising a generally planar board having a first and a second electrically-conductive trace formed thereon and having a first and a second major surface, wherein the first trace is electrically coupled to the first conductor at a first location on the first major surface and extends along the first major surface to a second location on the first major surface, and the second trace is electrically coupled to the second conductor at a third location on the first major surface and extends along the first and the second major surfaces to a fourth location on the second major surface.

2. The cable harness assembly of claim 1, wherein a via is formed in the board and the second trace extends between the first and the second major surfaces through the via.

3. The cable harness assembly of claim 1, wherein the first major surface forms a top surface of the board, the second major surface forms a bottom surface of the board, and the third and the fourth locations are substantially vertically aligned.

4. A cable harness assembly, comprising:

a paddle-card termination comprising (i) a generally planar board having a first and a second electrically-conductive trace formed thereon and having a first and a second major surface, (ii) a first, second, and third electrically-conductive pad disposed on the first major surface, (iii) a fourth electrically-conductive pad disposed on the second surface, (iv) a first electrically-conductive trace extending between the first and the third pads, and (v) a second electrically-conductive trace extending between the second and the fourth pads; and a shielded cable comprising a first conductor electrically and mechanically coupled to the first pad and a second conductor electrically and mechanically coupled to the second pad.

5. The cable harness assembly of claim 4, wherein the cable further comprises a first insulator disposed around the first conductor, a second insulator disposed around the second conductor, and a shield disposed around the first and second insulators.

6. The cable harness assembly of claim 4, wherein the board has a via formed therein and the second trace extends between the first and the second major surfaces through the via.

7. The cable harness assembly of claim 4, wherein the first and second conductors are electrically and mechanically coupled to the respective first and second pads by soldering.

8. The cable harness assembly of claim 4, further comprising a second of the cables, wherein the cable termination further comprises (i) a fifth electrically-conductive pad disposed on the first major surface, (ii) a sixth electrically-conductive pad disposed on the second major surface and electrically and mechanically coupled to a first conductor of the second of the cables, (iii) a seventh electrically-conductive pad disposed on the second major surface and electrically and mechanically coupled to a second conductor of the second of the cables, (iv) an eighth electrically-conductive pad disposed on the second major surface, (v) a third electrically-conductive trace extending between the fifth and the sixth pads, and (v) a fourth electrically-conductive trace extending between the seventh and the eighth pads.

9. The cable harness assembly of claim 8, wherein the first major surface forms a top surface of the board, the second major surface forms a bottom surface of the board, the first and the sixth pads are substantially vertically aligned, the second and the seventh pads are substantially vertically aligned, the third and the fourth pads are substantially vertically aligned, and the fifth and the eighth pads are substantially vertically aligned.

10. The cable harness assembly of claim 8, wherein the board has a first and a second via a formed therein, the second trace extends between the first and the second major surfaces through the first via, and the third trace extends between the first and the second major surfaces through the second via.

11. The cable harness assembly of claim 8, wherein each of the cables comprises a drain line, the cable termination further comprises a first ground plane disposed on the first major surface and a second ground plane disposed on the second major surface, the drain line of the first of the cables is electrically and mechanically coupled to the first ground plane, and the drain line of the second of the cables is electrically and mechanically coupled to the second ground plane.

12. A plug assembly adapted to electrically couple a receptacle adapted to mate with the plug assembly and a shielded cable comprising a first and a second conductor, the plug assembly comprising:

an insulative body having a first and a second electrically-conductive trace formed thereon and each being adapted to engage a respective contact on the receptacle;

a paddle-card termination comprising (i) a generally planar board having a first and a second major surface, and (ii) a first and a second electrically-conductive pad disposed on the first surface and adapted to be electrically and mechanically coupled to the respective first and second conductors, and a first and a second contact mounted on the body and electrically coupled to a respective one of the first and second electrically-conductive traces, wherein the first contact is mechanically coupled to the first major surface and electrically coupled to the first electrically-conductive pad and the second contact is mechanically coupled to the second major surface and electrically coupled to the second conductor.

13. The plug assembly of claim 12, wherein the body comprises a main portion and an adjoining shelf portion having the traces formed thereon.

14. The plug assembly of claim 12, wherein the first and second contacts each comprise a pin portion mechanically coupled to a respective one of the first and second electrically-conductive traces and an adjoining beam portion mechanically coupled to the respective first and second major surfaces.

15. The plug assembly of claim 12, further comprising a casing, wherein the body, the cable termination, and the first and second contacts are disposed substantially within the casing.

16. The plug assembly of claim 12, wherein the first contact is mechanically coupled to a third electrically-conductive pad on the first major surface and the second contact is mechanically coupled to a fourth electrically-conductive pad on the second major surface.

17. The plug assembly of claim 12, wherein the first contact is electrically coupled to the first electrically-conductive pad by an electrically-conductive trace extending along the first major surface and the second contact is electrically coupled to the second electrically-conductive pad by an electrically-conductive trace extending along the first and the second major surfaces.

18. The plug assembly of claim 12, wherein the second electrically-conductive trace extends between the first and the second major surfaces through a via formed in the board.

19. The plug assembly of claim 12, wherein the first and second contacts are mechanically coupled to the respective first and second major surfaces by soldering.

20. A connector system, comprising:

a plurality of shielded cables each comprising a first and a second conductor for conducting a pair of differential signals;

a plug assembly comprising an insulative body, a plurality of contacts mounted on the body in a first and a second row, and a paddle-card termination at least partially disposed between the first and the second rows, wherein the first and the second conductors of each of the cables are mechanically coupled to a common side of the board, the first conductor of each of the cables is electrically coupled to one of the contacts in the first row, and the second conductor of each of the cables is electrically coupled to one of the contacts in the second row; and a receptacle adapted to mate with the plug assembly and comprising a plurality of contacts each being adapted to electrically contact a respective one of the contacts of the plug assembly when the receptacle is mated to the plug assembly.

21. The connector system of claim 20, wherein the plurality of shielded cable each comprise a drain line, the cable termination further comprises a first ground plane disposed on the first side the board and a second ground plane disposed on the second side of the board, the drain line of a first plurality of the cables are electrically and mechanically coupled to the first ground plane, and the drain lines of a second of the cables are electrically and mechanically coupled to the second ground plane.

22. The connector system of claim 20, wherein each of the contacts in the first row is substantially vertically aligned with a respective one of the contacts in the second row.

* * * * *